US005729932A

United States Patent [19]

Ban

[11] Patent Number: 5,729,932

[45] Date of Patent: Mar. 24, 1998

[54] STRUCTURAL FURNITURE

[76] Inventor: Shigeru Ban, 5-2-4, Matsubara, Setagaya-ku, Tokyo, Japan

[21] Appl. No.: 685,246

[22] Filed: Jul. 23, 1996

[30] Foreign Application Priority Data

Oct. 4, 1994 [JP] Japan ..... 6-264696

[51] Int. Cl.[6] ..... E04F 19/08

[52] U.S. Cl. ..... 52/36.4; 312/242; 312/245

[58] Field of Search ..... 52/36.4, 36.5; 312/242, 245, 204

[56] References Cited

U.S. PATENT DOCUMENTS

| | | | |
|---|---|---|---|
| 891,389 | 6/1908 | Watts | 52/36.4 X |
| 1,476,785 | 12/1923 | White | 52/36.4 |
| 1,535,842 | 4/1925 | MacDonald | 52/36.4 |
| 2,070,641 | 2/1937 | Bartels | 52/36.4 X |
| 2,396,550 | 3/1946 | Awiszus | 52/36.4 X |
| 3,834,092 | 9/1974 | Whisson | 52/36.4 |
| 3,915,524 | 10/1975 | Langston | 312/228 X |
| 3,943,581 | 3/1976 | Reyes | 312/228 X |
| 4,002,383 | 1/1977 | Holloway, Jr. | 312/228 X |
| 4,446,660 | 5/1984 | Miller et al. | 312/245 X |
| 5,245,802 | 9/1993 | Davis | 52/36.4 X |
| 5,368,378 | 11/1994 | Curtis | 312/242 X |

FOREIGN PATENT DOCUMENTS

| | | | |
|---|---|---|---|
| 406257278 | 9/1994 | Japan | 52/36.4 |

*Primary Examiner*—Carl D. Friedman
*Assistant Examiner*—Yvonne Horton-Richardson
*Attorney, Agent, or Firm*—Trapani & Molldrem

[57] ABSTRACT

A structural furniture in which at least a portion thereof has a strength required for a structural member and constitutes a structural member bearing loads in a vertical direction and a lateral direction. Back plate constituents made of structural plywoods are stood vertically in parallel with each other on bottom plates and side plates 4 are stood vertically being joined at a right angle to the back plate constituent members 3 so as to form a U-shaped lateral cross section.

7 Claims, 2 Drawing Sheets

STRUCTURAL FURNITURE

BACKGROUND OF THE INVENTION

1. Field of the Invention

The present invention concerns a structural furniture such as, for example, a display shelf, drawer, bookcase, closet, kitchen unit or like other storage furniture in which a portion of such a furniture (particularly, a back plate constituent) is used as a structural member bearing loads in a vertical direction and a lateral direction (that is, a pillar or wall) thereby enabling to save the use of pillars or walls, as well as unitize a building such as a house and can manufacture and supply them at a reduced cost.

2. Description of the Prior Art

A prefabricated housing system has been adopted so far, and construction systems, for example, a two-by-four construction method, panel construction method, and construction method of connecting light-weight structural steels and boxes (rooms) have been conducted in recent years.

However, in such existent construction methods, unitization structure in factories has been made, at the most, to such an extent as utilizing existent pillars or walls as structural members for bearing loads in the vertical and lateral directions, and ready-made furnitures have to be installed separately as necessary or built-in furnitures have to be installed separately in the same manner as usual, which requires skilled carpenters and the number of such carpenters has been decreased year by year and wages have increased more and more. Under such situations in the field of buildings, the cost reduction has also come to its limit to the extent of relying on a method of using inexpensive imported materials conducted so far or reviewing the distribution system.

SUMMARY OF THE INVENTION

It is, therefore, an object of the present invention to provide a structural furniture which requires no special skills, can be manufactured in factories, can improve the construction accuracy remarkably and can reduce the construction cost.

The present inventor has made earnest studies for overcoming the foregoing problems to attain the object described above and, as a result, has accomplished the present invention based on the finding that the object can be attained by utilizing a furniture, particularly, a back plate constituent thereof as a structural member bearing loads in a vertical direction and a lateral direction.

That is, the present invention provides a structural furniture in which at least a portion thereof has a strength required for a structural member and constitutes a structural member bearing loads in a vertical direction and a lateral direction.

That is, the structural furniture of the present invention is selected from at least one of a display shelf, drawer, bookcase, closet, kitchen unit and like other storage furnitures, which can be manufactured under modulation in factories and such moduled structural furnitures are preferably moduled in two types of 90 cm width and 75 cm or 45 cm depth.

In the structural system of the present invention, furnitures are provided also with all the structural and spatial partitioning functions which were attributable so far to pillars or walls. The furnitures described above are moduled into two types of 90 cm width and 75 cm or 45 cm depth as described above and disposed while considering the room layout and the structure (vertical force and lateral force). The furniture is manufactured in a factory by incorporating heat insulator materials as required, attaching side plates, disposing doors to the side plates, attaching a shelf board between the side plates, laying pipes used for hangers, appending exterior wall material or completing operation as far as painting and then carried into a construction site.

When they are put to assembling construction, sleepers (square lumbers) are secured on concrete foundations, joists are laid between the sleepers and bottoms of structural plywoods are attached thereon. Then, the furniture according to the present invention (specifically, back plate constituent) is secured on the bottom plate of structural plywoods, for example, by means of lug screws. On the other hand, beams are secured to the upper end of the furniture, over which a roof is secured or structural furnitures in an upper story are installed. A house can be constructed by using the thus secured structural furnitures.

DETAILED DESCRIPTION OF PREFERRED EMBODIMENTS

Figure 1:
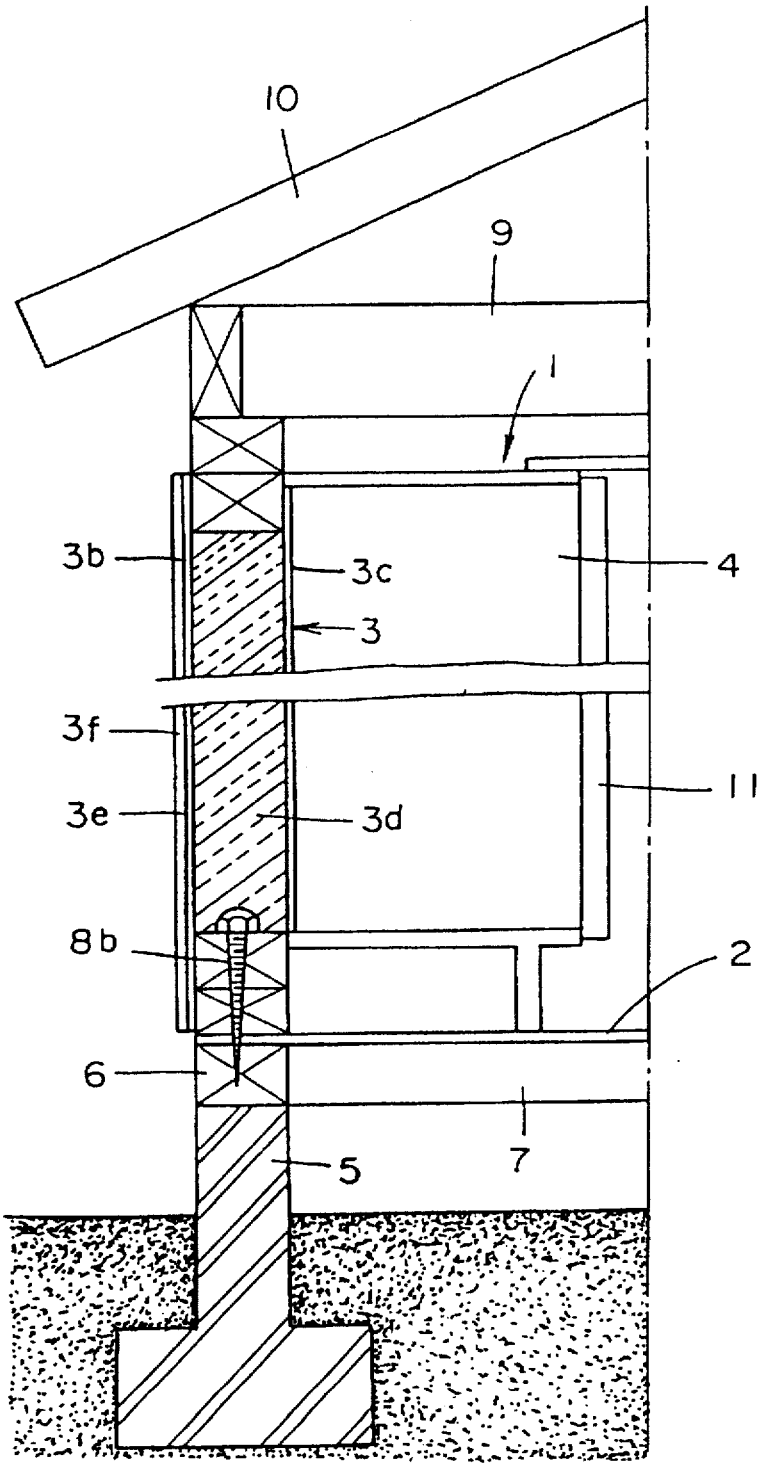
FIG. 1 is a side elevational cross sectional view illustrating an example of using a structural furniture in one embodiment according to the present invention.

Then, the present invention is to be explained by way of a preferred embodiment with reference to the accompanying drawings.

A structural furniture module 1 is constituted as described below. That is, two sheets of back plate constituents 3 each of 90 cm width and 240 cm height are stood vertically in parallel with each other on each of bottom plates 2 made of structural plywood, respectively. The back plate constituent 3 comprises a structural plywood **3*b* and a plywood 3*c* attached, respectively, to the outward-facing surface and the inward-facing surface of a plurality of parallel studs 3*a* (three in the illustrated embodiment), with a heat insulator 3*d* being disposed at the inside. Side plates 4 each of 45 cm width (depth as a module) and 240 cm height are joined in perpendicular to the sides of the back plate constituent 3** so as to constitute a U-shaped transversal cross section.

An outer wall material **3*f* is appended or coating is applied by way of water proof paper 3*e* to the outside of the outward-facing structural plywood 3*b* of the back plate constituent 3**.

Figure 2:
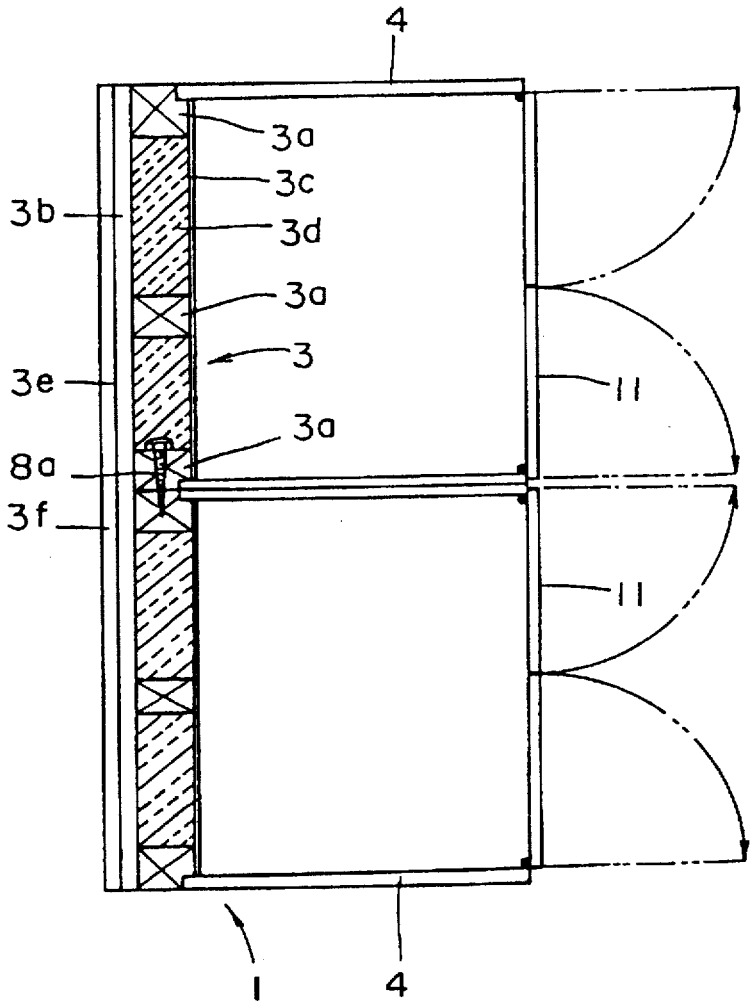
FIG. 2 is a plan view illustrating an example of connecting a structural furniture in one embodiment according to the present invention.

The structural furniture according to the present invention is thus constituted and furniture modules such as a closet, bookcase and kitchen are disposed while considering the room layout and the structure (vertical force and horizontal force). That is, sleepers (square lumbers) 6 are secured on concrete foundations 5, joists 7 are laid between the sleepers 6, on which the bottom plates 2 made of the structural plywood are attached. Then, as described above, after placing the back plate substitutes 3 of the structural furniture module 1 according to the present invention on the bottom plates 2 and, setting them to each other if they are disposed side by side in plurality, with lug screws **8*a* as necessary as shown in FIG. 2, and they are fixed by way of the bottom plates 2 to the sleepers 6 by means of lug screws 8*b*. Further, the side plates 4 for each of the structural furniture modules 1 are secured to the sides of the back plate constituents 3, for example, by means of bolts or adhesives. While on the other hand, beams 9 are fixed above the structural furniture module 1, on which a roof 10** is secured, or structural furnitures of an upper story are secured to constitute the upper story in the same manner as described above.

Since doors 11 are disposed to the front of the structural furniture, shelve are attached between the side plates 4, or pipes for hangers are laid previously to complete a furniture in a manufacturing factory for structural furnitures, operators have only to assemble them in the working site.

In the above-mentioned embodiment, a structural furniture module having a U-shaped transversal cross section is illustrated but various kinds of shapes can be adapted depending on the application uses, and an I-shaped transversal cross section may be used, for example, in a display shelf.

In the present invention, since the furniture, in particular, the back plate constituents thereof is utilized as a structural member bearing the vertical and lateral loads, the furniture can be provided also with all of structural and spatial partitioning functions which were attributable so far to pillars or walls, they can be produced in factories, operation in the construction site can be outstandingly mitigated to shorten the construction term and the accuracy for assembling and painting work can be improved extremely as compared with that in the field work, as well as know-how, factories and skilled workers in the field different from those in the field of construction can be utilized, to enable cost reduction or create new possibility, which result in remarkable advantageous effects.

What is claimed is:

1. A prefabricated structural furniture to be incorporated into the wall of a dwelling or similar building, in which at least a back wall portion of the structural furniture constitutes a structural member bearing loads in a vertical direction and in a lateral direction; wherein said back wall portion includes two sheets of back plate in parallel with each other, and a plurality of vertical studs therebetween.

2. A structural furniture as defined in claim 1, wherein the structural furniture is selected from at least one of a display shelf, drawer, bookcase, closet, kitchen unit and like other storage furniture.

3. A structural furniture as defined in claim 1, wherein the structural furniture is modular.

4. A structural furniture as defined in claim 1, wherein the moduled structural furniture can be manufactured in a factory.

5. A structural furniture as defined in claim 1, wherein the moduled structural furniture is moduled into two types, that is, having 90 cm width and 75 cm or 45 cm depth.

6. A structural furniture as defined in claim 1, wherein said back wall portion includes thermal insulating material disposed between said two sheets of back plate.

7. A structural building which comprises a foundation, a lower horizontal member secured onto the foundation, at least one load-bearing wall supported vertically on said lower horizontal member, an upper beam supported atop said load-bearing wall and which carries the weight of further building structure positioned above it; and a structural furniture which includes a structural back wall member constituting a structural member to form a portion of said load-bearing wall, bearing loads in a vertical direction and a lateral direction; including means securing a lower end of said back wall member to said lower horizontal member and means securing an upper end of said back wall member to said upper beam; wherein said back wall member includes two sheets of back plate in parallel with each other, and a plurality of vertical studs therebetween.

* * * * *